US007669736B2

(12) United States Patent
Harper

(10) Patent No.: US 7,669,736 B2
(45) Date of Patent: Mar. 2, 2010

(54) RESEALABLE PACKETS OF LIQUID

(76) Inventor: William A. Harper, 16541 Redmond Way, pmb 140-C, Redmond, WA (US) 98052-4492

( * ) Notice: Subject to any disclaimer, the term of this patent is extended or adjusted under 35 U.S.C. 154(b) by 796 days.

(21) Appl. No.: 11/365,711

(22) Filed: Mar. 1, 2006

(65) Prior Publication Data

US 2007/0045340 A1 Mar. 1, 2007

Related U.S. Application Data

(60) Provisional application No. 60/710,853, filed on Aug. 24, 2005, provisional application No. 60/736,068, filed on Nov. 10, 2005.

(51) Int. Cl.
*B65D 35/56* (2006.01)

(52) U.S. Cl. ..... 222/105; 222/107; 383/200

(58) Field of Classification Search ..... 383/42, 383/203, 201, 77, 38, 88, 906, 200; 222/105, 222/107, 94, 96, 213, 214; 206/219, 528
See application file for complete search history.

(56) References Cited

U.S. PATENT DOCUMENTS

| | | | | | |
|---|---|---|---|---|---|
| 2,298,421 | A * | 10/1942 | Salfisberg | 383/106 |
| 2,319,560 | A * | 5/1943 | Salfisberg | 206/474 |
| 2,325,921 | A * | 8/1943 | Salflsberg | 221/64 |
| 2,976,988 | A * | 3/1961 | Schneider | 206/445 |
| 3,184,121 | A * | 5/1965 | Volckening | 222/213 |
| 3,224,640 | A * | 12/1965 | Schneider et. al. | 222/107 |
| 3,278,085 | A * | 10/1966 | Brown | 222/107 |
| 3,460,741 | A * | 8/1969 | Kugler | 383/38 |
| 3,608,709 | A * | 9/1971 | Pike | 206/219 |
| 4,163,509 | A | 8/1979 | Amneus | |
| 4,252,257 | A | 2/1981 | Herzig | |
| 4,679,688 | A * | 7/1987 | Soderholm et al. | 206/204 |
| 4,776,455 | A * | 10/1988 | Anderson et al. | 206/0.5 |
| 4,805,767 | A * | 2/1989 | Newman | 206/219 |
| 4,998,671 | A * | 3/1991 | Leifheit | 239/44 |
| 5,228,782 | A | 7/1993 | Imer | |
| 6,244,468 | B1 | 6/2001 | Farmer | |
| 6,783,030 | B2 * | 8/2004 | Redmond | 222/107 |
| 6,811,057 | B2 * | 11/2004 | Duquet et al. | 222/105 |
| 7,004,354 | B2 | 2/2006 | Harper | |
| 7,178,671 | B2 * | 2/2007 | Nichols et al. | 206/438 |
| 7,207,970 | B2 * | 4/2007 | Hasegawa | 604/90 |
| 2001/0047162 | A1 * | 11/2001 | Yugari | 604/410 |
| 2007/0045341 | A1 * | 3/2007 | Bauer | 222/107 |

OTHER PUBLICATIONS

David L Dyer, PHD; Arnold Shinder, DO; Fay Shinder, RN, Alcohol-free Instant Hand Sanitizer Reduces Elementary School Illness Absenteeism, Oct. 2000, Clinical Research and Methods, vol. 32, No. 9 pp. 633-638.*

* cited by examiner

*Primary Examiner*—Lien T Ngo

(57) ABSTRACT

Disclosed is a pocketable container in the form of a resealable polymeric packet designed to hold and disperse multiple doses of a useful fluid. Resealing is achieved by means of a simple yet reliable fold closure technique making possible a cost effective tool for carrying about small quantities of useful liquids, specifically hand sanitizing fluids for control of sickness and infectious disease in a human population.

18 Claims, 4 Drawing Sheets

FIG. 11
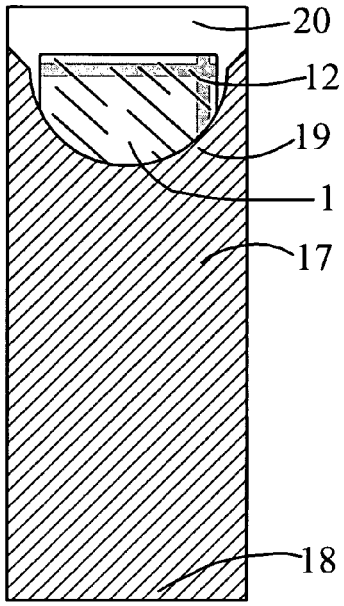
FIG. 12
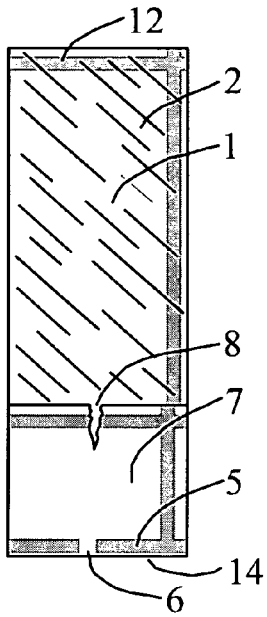
FIG. 13
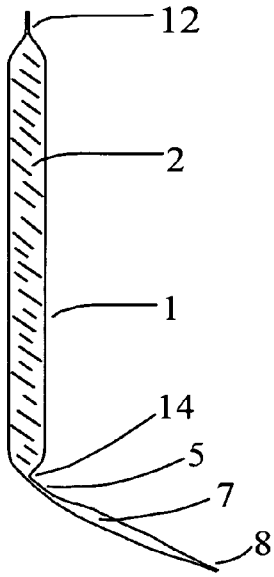
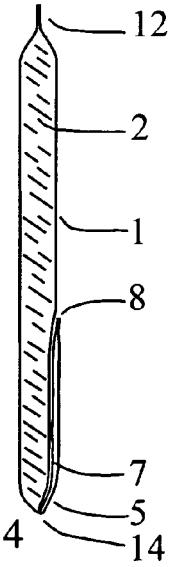
FIG. 14
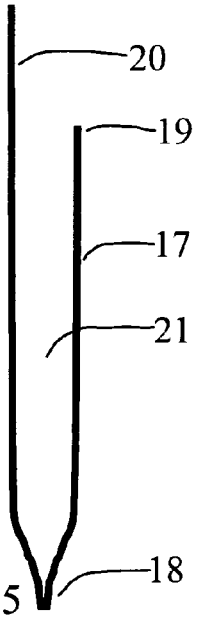
FIG. 15
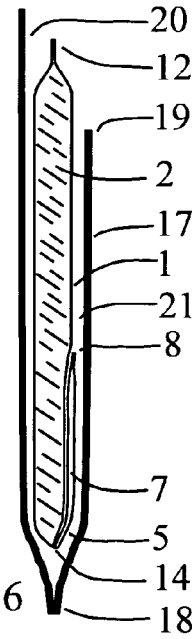
FIG. 16

FIG. 17
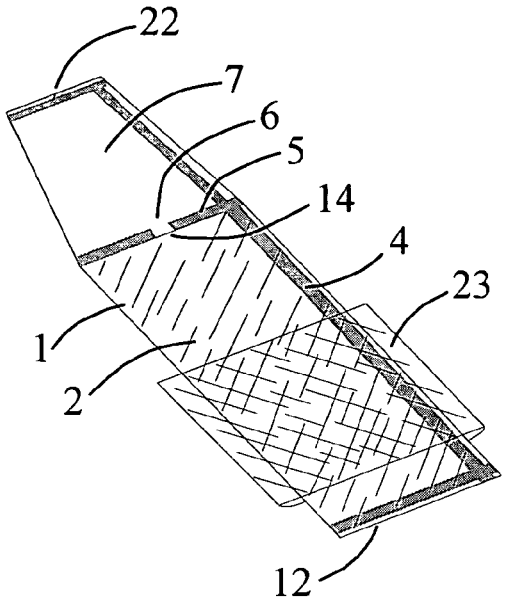
FIG. 18
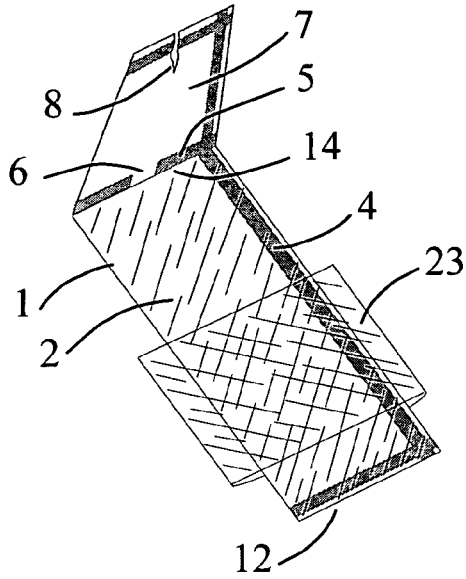
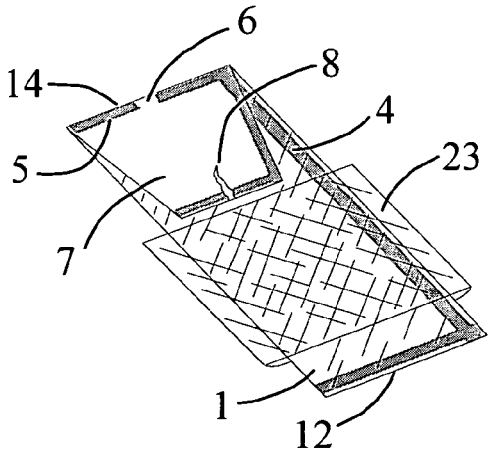
FIG. 19
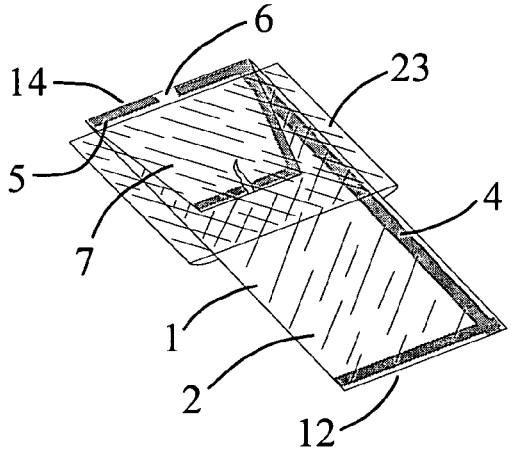
FIG. 20

RESEALABLE PACKETS OF LIQUID

The present application claims priority to provisional applications No. 60/710,853, filed 24 Aug. 2005, entitled "Liquid Packet with Cover"; and No. 60/736,068, filed 10 Nov. 2005, entitled "Resealable Packets of Liquid".

FIELD OF THE INVENTION

This invention relates generally to resealable polymeric packets designed to hold and disperse multiple doses of a useful fluid. Specifically, the present invention discloses a simple and reliable fold closure technique for resealing small, disposable, bi-chambered, multidose packets of liquid.

BACKGROUND OF THE INVENTION

The packaging of liquids and particularly the resealing of opened liquid packets has always had the twin challenges of operational simplicity and reliable leak prevention. Whatever the design it must be intuitively easy to operate by users with widely ranging physical abilities; equally important is absolute leakage control which not only prevents product loss but also avoids damage to surrounding materials and circumstances. Above all, the design must provide these features in the form of a very low cost, small, disposable packet. Numerous inventive designs have been put forth over many years to meet these well recognized challenges. The following are representative of the current art.

Salfisberg, U.S. Pat. No. 2,325,921 (1943) describes a polymeric packet for distribution of tablets or liquids. The design includes a material reservoir, a discharge neck, a matchbook-style cover that when closed and held folds the discharge neck so as to prevent accidental discharge. This design has no controlling barrier feature or restrictive passage so the relatively large discharge channel permits substantial leakage whenever even minor incidental external pressure is applied to the liquid reservoir.

Schneider, U.S. Pat. No. 2,976,988 (1961) describes a polymeric packet for distribution of tablets or liquids. Two chambers, reservoir and distribution, are connected by a passage designed to control liquid exchange by simple stretch tension produced by the polymeric walls of the packet, opened under fluidic pressure, and resealing when the fluidic pressure is released. No other resealing features such as a fold are provided and application of inadvertent pressure to the liquid through the walls, such as found in a purse or pocket, is more than sufficient to produce a substantial product discharge with subsequent loss and damage.

Schneider, U.S. Pat. No. 3,224,640 (1965) describes a flexible polymeric packet with an extended discharge channel that is folded over and held against the packet by placing the discharge end in a slit pocket formed as part of the packet wall. This one chamber design absent a controlling barrier feature and restrictive passage is very prone to leakage particular along the channel edges where the fold and side seals meet but fail to provide effective closure.

Amneus, U.S. Pat. No. 4,163,509 (1979) describes a dispensing container with an elongated discharge spout ending in a tension curl valve designed to uncurl and release fluid when a stripping action is applied to the length of the discharge spout. Due to the relatively stiff tension required to maintain the curl for leakage control, the design is better adapted to wall hanging and mechanical operation and precludes the convenience of a pocket carried version.

Herzig, U.S. Pat. No. 4,252,257 (1981) describes a flexible container employing a transverse pinch-off valve at the discharge slit that opens when pressure is applied to key areas of the container adjacent to a pinch-off line. Practice has shown the tension of the valve quickly fatigues and leakage results. Ease of manipulation has also proven problematic.

Imer, U.S. Pat. No. 5,228,782 (1993) describes a polymeric sachet with a liquid reservoir and narrow outlet channel through which the liquid is discharged. The sachet is resealed by folding the strap in which the narrow channel is located at a 45° angle and fitting the strap extension into a holding slit thus sealing the channel. In practice the strap manipulation is cumbersome to operate and prone to accidental discharge and leakage. Additionally the lack of a distribution chamber to control pressure discharge and dose measurement makes dispersement messy and erratic.

Farmer, U.S. Pat. No. 6,244,468 (2001) describes a liquid sachet with two chambers formed by seals, a connecting inlet, and an exit point resealable by twin tension folds traversing the opening that unfold under hydraulic pressure to disperse the liquid. The tension necessary to hold the folds shut is necessary slight so as to appropriately respond to an opening pressure that needs to remain within moderate limits, this requirement and the lack of any fold holding means makes the folds vulnerable to accidental opening, discharge, and leakage when inadvertently manipulated by movements and conditions typically found in a pocket, briefcase, or purse.

Harper, U.S. Pat. No. 7,004,354 (2006) describes a self-sealing polymer packet with reservoir and dispersement chambers, a traversing barrier seam forming the chambers, and an active choke valve in the barrier seam that restricts pressurized liquid passage unless opened by intentional contortion of the packet walls. In practice the design presents operational challenges to users with small hands, arthritic fingers, or limited dexterity. Additionally, some users disbelieve a miniscule choke valve can adequately reseal the packet, preferring a more obvious and robust closure system to prevent leakage.

The present invention recognizes the numerous seal variations found in the foregoing prior art and specifically addresses their individual and collective disadvantages and shortcomings. Salfisberg's matchbook packaging with a fold closure held in place by a cover is simple, somewhat intuitive, cost effective, but leaks badly. Schneider '640 and Imer disclosed fold-and-hold designs that are both cumbersome to operate and prone to leakage and discharge. Schneider '988 introduced the bi-chamber and contolling barrier features together with cost effectiveness but failed to provide a robust closure system against leakage. Amneus, Herzig and Farmer all employed spout closure designs that relied upon material tension to control leakage, such designs are prone to accidental external manipulation that allows leakage, particularly in small packets intended for pocket or purse carrying. The Harper packet with the active choke seal design provides effective measurement and dose dispersal, together with cost effectiveness and good leak protection, but opening the seal is not easy for all users. Despite all these efforts there is still an unmet need for a novel closure system that makes secure, resealable liquid packets a simple reality for all users.

SUMMARY OF THE INVENTION

All the elements for creating a small, disposable, resealable, leak proof packet exist in the prior art, however these elements must be carefully selected out of the general clutter and then arranged in a new and novel way to achieve a truly effective result, a result so far not yet achieved despite continuous efforts by numerous skilled designers over many years. A key component of the present invention is to provide a closure means where a controlling barrier and restrictive passage interact with a proximate parallel fold to alternatively permit or prevent fluid passage between two chambers and subsequent exit of the packet. The packet is formed of opposing walls of a supple imperforate material interconnected along at least one edge by a seam. The walls define a space bisected by a controlling barrier seam containing a restrictive passage connecting a larger reservoir and smaller distribution chamber. Contained within the packet is a liquid in fluidic communication between the chambers and capable of exiting the distribution chamber in multiple measured doses though a user created tear in the periphery of the distribution chamber. Resealing the open packet is accomplished by folding the packet at a fold line immediately adjacent to the controlling barrier creating an effective seal closing the restrictive passage by the immediate proximity of packet fold bringing the two opposing walls into a crimped closure system. The controlling barrier effectively prevents leakage across the width of the packet that has defeated much of the earlier art, and the relatively narrow restrictive passage which focuses flow movement, working in concert with the fold, tightly shuts and prevents fluidic exchange between chambers and subsequent measured dispersement. The fold can be held shut by various techniques; four representative examples of fold holding means are described as cover, tab, case, and slide.

A primary object of the present invention is to provide a fluid dispensing apparatus in the form of a packet which employs a controlling barrier, a restrictive passage, and an immediate fold working in concert to provide reliable resealing which makes possible a small, flat, multidose, easy use, reliable, cost effective tool for carrying about small quantities of useful liquids, specifically a hand sanitizing fluid for control of sickness and infectious disease in a human population.

Another object of the present invention is to provide a method for allocating multiple varied measured doses of a useful liquid as needed.

Another object of the present invention is to provide a means by way of a resealable packet for promoting better health by access to a hand sanitizing fluid making possible clean hands when and where needed.

Another object of the present invention is to provide surfaces and/or chambers that bear meaningful communications which encourages distribution and use of resealable packets of useful liquids.

A final object of the present invention is to provide liquid packets with an intuitively simple and easily manipulated resealing means for the immature or impaired user.

Other objects and advantages of the present invention will become apparent from the following description taken in conjunction where appropriate with the accompanying drawings wherein are set forth, by way of illustrations and example, certain embodiments of this invention. The drawings constitute a part of this specification and include exemplary embodiments of the present invention and illustrate various objects and features thereof.

BRIEF DESCRIPTION OF THE DRAWINGS

The invention is best understood and objects other than those set forth above will become apparent when consideration is given to the following detailed description thereof. Such description makes reference to the annexed drawings wherein:

FIG. 11 is a frontal view of a folded liquid packet held within a case so as to seal the open packet shut.

FIG. 12 is a frontal view of the previous figure of the packet removed from the case to show various packet elements.

FIG. 13 is a side view of the previous figure of the packet with the distribution chamber partially unfolded.

FIG. 14 is a side view of the previous figure with the distribution chamber folded against the reservoir chamber.

FIG. 15 is a side view of the case showing various elements.

FIG. 16 is a side view showing the folded packets enclosed by case so as to seal the packet at the controlling barrier fold line.

FIG. 17 is a perspective view of a flat bi-chambered packet with an encircling slide position around the reservoir chamber.

FIG. 18 is a perspective view of the previous figure showing the packet partially folded, the slide, and packet elements.

FIG. 19 is a perspective view of the previous figure showing the distribution chamber folded against the reservoir chamber at the controlling barrier fold line.

FIG. 20 is a perspective view of the previous figure showing the slide moved to a position in which both chambers are encompassed, held together, and the fold at the controlling barrier line forms a seal between the chambers.

DETAILED DESCRIPTION OF THE INVENTION

Figure 1:
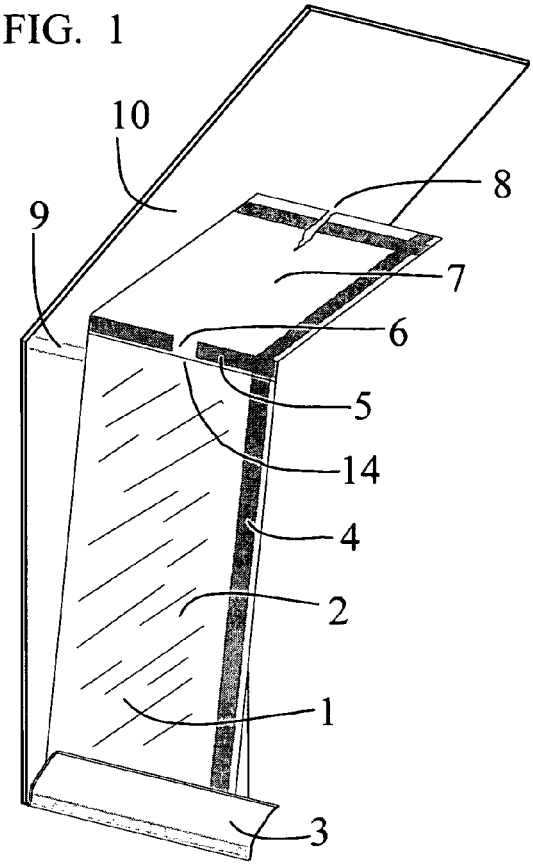
FIG. 1 is a perspective view of a matchbook-style package with the cover open and the bi-chambered packet partially extended.

While the invention will be described in connection with illustrations, descriptions, and examples of preferred embodiments, it will be understood these are not intended to limit the present invention only to these embodiments. On the contrary, the present invention is to cover all structural and/or functional alternatives as generally described.

The term "hand sanitizing fluid" as used herein refers to any non-irritating, antimicrobial-containing composition in the form of a fluid, gel, spray, foam, cream, lotion, or tincture preparation designed for frequent use that can reduce the number of transient microorganisms, specifically pathogens, when applied to and dispersed over the hands and other skin areas. Such preparations have a broad antimicrobial spectrum, are fast-acting, and are often persistent. Representative of such agents are alcohols (e.g. ethyl and isopropyl), iodines (e.g. hexachlorophene), bisbiquanides (e.g. Chlorhexidine digluconate), and quaternary ammonium salts (e.g. Benzalkonium chloride) which are formulated singularly or in combination. This term is specifically intended to include all such preparations, known and unknown, that are capable of achieving a substantial reduction of skin resident pathogens when applied to the hands or other areas of skin where such pathogens are found.

The term "flexible polymeric material" as used herein refers to any polymer film capable of being constructed into a packet for containment and preservation of useful liquid such as a hand sanitizing fluid. Such polymer films as may prove useful for this purpose have sufficient flexibility to yield to finger pressure, are sufficiently durable to withstand reasonable hydraulic pressure created by fingers, have good crack and puncture resistance, have very good chemical resistance and low gas permeability, and are capable of being sealed to self or other materials. Representative of such films are polypropylene and polyethylene in single formulations, multiple polymers laminates with barrier layers, and various combining composites including metal films. Numerous grades, gauges, textures, combined in many lamination varieties, formed by many techniques, with numerous additives, and an even greater numbers of formulations provide a wide array of polymeric materials to select from, singularly or in combination, to satisfy the specific chemical, physical, and aesthetic attributes required for a specific packet's construction, its content's formulation, and the precise function for which it is intended. All known and yet unknown polymer materials functionally suited for use in constructing multi-dose packets containing hand sanitizing fluids and other like useful liquids are envisioned by use of this term.

The term "useful liquids" as used herein refers to any substance with the capacity to demonstrate fluidity. Specifically, liquids are described by many forms that include but are not limited to mixtures of homogeneous and non-homogeneous substances, solutions, suspensions, colloids, sols, and similar terms. "Useful" connotes a utility aspect for employing the dispensed liquids characterized by common products, forms, and categories such as additives, adhesives, aftershaves, alcohol solutions, antibiotic ointments, antifungal cream, anti-itch creams, antimicrobial fluids, antiseptic creams, baby formulas, bandages, bath oils, beverages, bleaches, body oils, body washes, breath fresheners, butters, candies, cleaner oils, cleaners, coffee extracts, colognes, colorants, condiments, conditioners, creamers, creams, dairy products, decongestants, deodorants, disinfectants, drinks, edible oils, emulsions, essential oils, eye drops, eye lubricants, fabric conditioners, fabric softeners, fertilizers, flavorings, foods, fragrances, fruit jellies, fruit spreads, fuel treatments, gels, glass cleaners, gravies, greases, hair treatments, hairdressings, hand sanitizers fluids, hand soaps, herbal extracts, honeys, insect repellants, jams, liniments, lip balms, lotions, makeup fluids, margarines, marmalades, medications, mineral solutions, moisturizers, mouthwashes, nectars, oils, ointments, paints, pastes, perfumes, petroleum jellies, polishes, preserves, salad dressings, salsas, sauces, seasonings, shampoos, skin cremes, skin lotions, skin moisturizers, skin toners, soaps, soups, spices, spreads, stain removers, styling creams, styling gels, sugar solutions, sun screens, sweeteners, syrups, tea extracts, toothpaste, vegetable milks, vegetable oils, vinegars, vitamin solutions, waxes, and similar items, descriptions, and functions. This utility quality of the liquid distinguishes "useful liquids" as defined herein from liquids that are never intended for disbursement from their containers such as those found in gel filled mouse pads and like novelties.

The term "meaningful communications" as used herein refers to any informational, educational, entertainment, and similar content exchange techniques expressed in any visible or tactile format. Specifically, any and all forms of the graphic arts including the printed word, pictorial representations, photography, illustrations, art and similar sight or tactile based forms of communication. Included are recent advancements in reprographic technologies such as embossed and printed holograms, laser printing, inkjet printing, rainbow printing and the older dimensional forms such as intaglio printing are specifically included. The content of the communication can takes many forms, including anagrams, addresses, advertising messages, call numbers, campaign points, catechisms, codes, company names, copyright materials, dates, event commemorations, decorative arts, facility names, formulas, fortune predictions, examinations, gaming symbols, illustrations, information, instructions, internet addresses, jokes, logos, lottery numbers, lottery symbols, lyrics, logogriphs, maxims, meaningful symbols, meaningful images, notations, questions, quips, photos, poetry, prayers, promotions, promotional slogans, proverbs, puzzles, quizzes, quotations, raffle numbers, redemption values, religious references, riddles, sayings, schedules, study aids, telephone numbers, tests, trademarks, voting messages, web addresses, witticisms, word definitions, word games and similar subject material.

The present invention is best understood by describing several examples that illustrate and describe how various aspects of each apparatus and technique functions; the exemplifying model chosen is a pocketable hand sanitizer packet. In each example the fold occurs on a line in immediate parallel proximity to the controlling barrier seam and restrictive passage where the fold works in conjunction with these features to create an effective resealing of the packet; this condition is common to each illustration. Example 1 details a liquid packet with a cover in a matchbook-style holding the fold closed so as to reseal an open packet (FIG. 1-5). Example 2 details a liquid packet where the fold is held closely by a partially attached tab behind which the dispersement chamber is positioned against the reservoir chamber and above the tab attachment point (FIG. 6-10). Example 3 details a liquid packet substantially enclosed in a case which holds the fold closed by the confining walls of the case (FIG. 11-16). Example 4 details a liquid packet with the fold held in place by a slide which encompasses the packet and can be moved up to hold the two chambers together or down to release the distribution chamber and the fold seal (FIG. 17-20). Numbered graphic elements are consistent across all FIGS. 1 through 20.

EXAMPLE 1

Resealable Packets of Liquid with Cover

An embodiment of the polymeric packet generally designated by the reference number 1 of FIGS. 1 through 5 has a peripheral seal 4 joining front and back sidewalls which have predetermined areas of transparency. These sidewalls may be constructed of flexible polymeric material (e.g., 2-mil polypropylene laminate) to enclose and contains a hand sanitizing fluid (e.g., gel containing 62% ethyl alcohol). The packet 1 is divided into two chambers separated by a controlling barrier seal 5 in which a restrictive passage gap 6 exists to permit fluidic communication between the two chambers. In this bi-chambered packet 1 the larger chamber is a reservoir chamber 2 in which multiple doses of the hand sanitizing fluid is stored and a smaller distribution chamber 7 that receives and measures fluid transfer from the reservoir chamber 2 when finger pressure is applied to the sidewalls of the reservoir 2. During fluid transfer the distribution chamber 7 receives the forcefully stream issuing through the open gap 6 so the dose can be controlled, measures, returned if necessary, and dispersed as desired.

Figure 2:
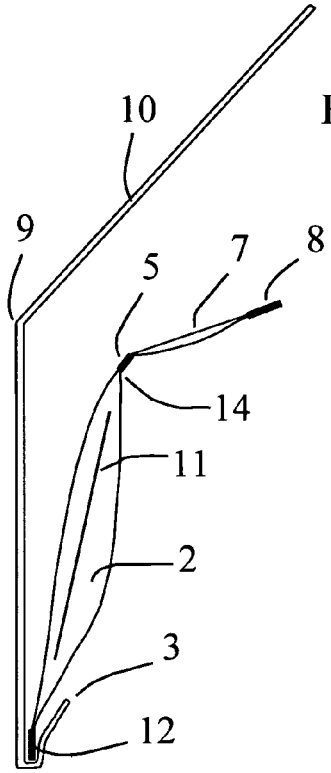
FIG. 2 is a side view of the previous figure showing the cover open, packet, the bottom fastening of packet to cover, and packet elements.
Figure 3:
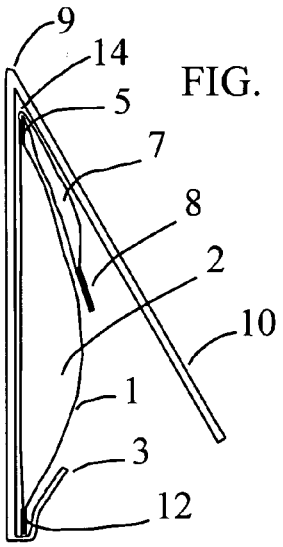
FIG. 3 is a side view of the previous figure showing a partially closed cover folding the distribution chamber back over the reservoir chamber.
Figure 4:
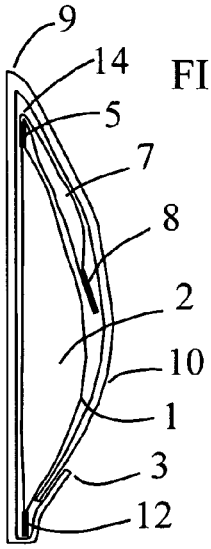
FIG. 4 is a side view of the previous figure showing the cover completely closed and engaged in the holding clasp.

Dispersal takes place through a tear 8 created with the first use; packets 1 are shipped fully sealed to protect and preserve the contents, the tear 8 is created to open the packet 1 for content distribution. In subsequent use the tear 8 can be held closed by fingers or left open while filling the distribution chamber 7 from the reservoir 2. The transferred dose can next be stripped out for precise dispersement into a receiving palm. Once the dispersement is completed, the distribution chamber 7 emptied, the packet 1 is closed by folding the cover 10 over and engaging the cover 10 end under the holding clasp 3 formed on the opposite end of the cover 10 where the packet 1 and cover 10 are attached 12. Closing the matchbook-style cover acts as a fold holding means for resealing the now opened packet. Folding the cover 10 for closure on the preformed fold 9 position also folds and holds the packet 1 at a predetermined fold line 14 that is in immediate parallel proximity to the controlling barrier 5 seam in a crimping arrangement where the distribution chamber 7 is folded back over the reservoir chamber 2. In an interactive manner the packet fold 14 and controlling barrier 5 are necessarily parallel and immediate one to the other and in a cooperative action effectively sealing the gap 6 and will continue this closure until the fold is released by opening the fold holding means, in this instance the matchbook cover 10. In FIGS. 2, 3, and 4 the sequence of closure steps is illustrated.

Figure 5:
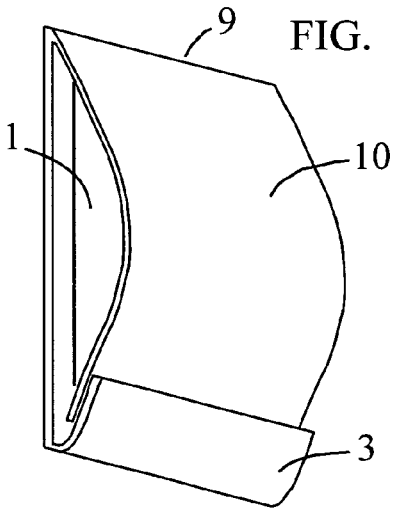
FIG. 5 is a perspective view of a matchbook-style package with closed cover that has sealed off the reservoir fluid from transfer into the distribution chamber and dispersing.

In FIG. 5 a perspective view of the complete package shows the cover 10 closed, the packet 1 enclosed, and the clasp 3 holding the cover 10 securely in place. Inside the packet is folded on a fold line 14 at the barrier seam 5 and held firmly in the cover's 10 crimping grasp so any liquid in the packet 1, regardless of any pressure placed upon it, can not pass through the gap 6. When the cover 10 is opened, the fold 9 releases the crimping hold on the packet 1; the gap 6 is now open to transfer fluids once more between chambers 2, 7. The relative narrowness of the gap 6 prevents inadvertent or high volume flow between the chambers 2, 7 without intentional pressure. The placement of an insert 11 in either or both chambers 2, 7 can assist handling, alignment, folding patterns and similar functions. Specifically, the shape and stiffness of the insert provides form, definition, and substance to the relatively flexible film of the enclosing packet. The presents of inserts 11 also better defines the structure of the packet chambers 2, 7 and can substantially enhances the ability of the packet fold to affect a secure closure of the gap 6 by this enhancing structural definition.

Placement of meaningful communications on the cover 10, insert 11, and/or packet 1 enhances distribution, acceptance, retention, and use of the packet product. The cover 10 and packet 1 may be partially and/or fully transparent, translucent, and/or opaque to facilitate manipulation, assessment, and/or enhancing communications. Further, aside from acting just as a holding means the cover 10 may provide improved control of the liquid in fluidic communications due to its greater surface area and relatively flat surfaces. These features so disclosed, in various combinations, constitute a new and useful package for dispersing fluids from liquid packets with covers.

EXAMPLE 2

Resealable Packets of Liquid with Tab

An embodiment of the polymeric packet designated by reference number 1 of FIGS. 6 through 10 has the same structural elements and other attributes as described in Example 1. The packet 1 performs in the same manner as described in Example 1. The critical closing feature where the packet 1 is folded along a fold line 14 proximate to the controlling barrier 5 and restrictive passage 6 to effect resealing is the same.

Figure 6:
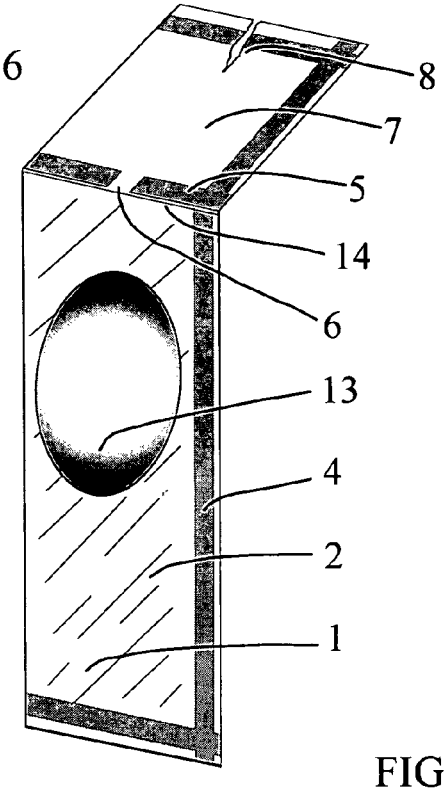
FIG. 6 is a perspective view of a liquid packet with a tab closure and the bi-chambered packet partially folded.
Figure 7:
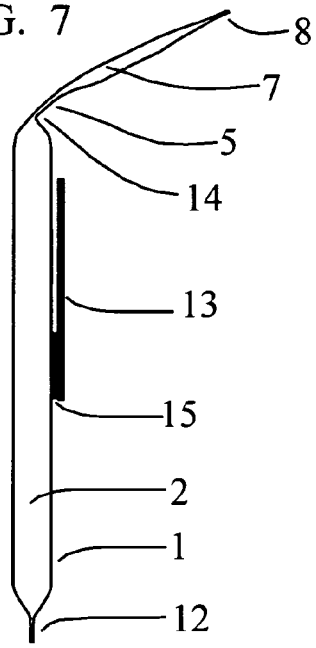
FIG. 7 is a side view of the previous figure showing the packet partially folded, the partially attached tab, and packet elements.
Figure 8:
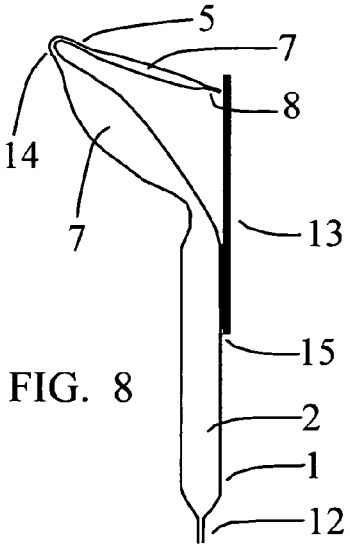
FIG. 8 is a side view of the previous figure showing a bent back packet that permits the distribution chamber to be placed behind the tab.
Figure 9:
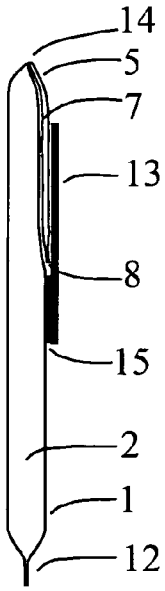
FIG. 9 is a side view of the previous figure showing a fully tucked distribution chamber behind the tab.
Figure 10:
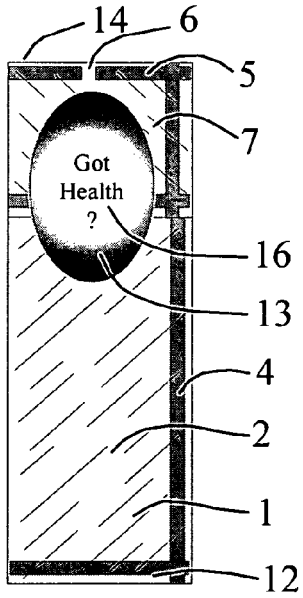
FIG. 10 is a frontal view of the previous figure showing the distribution chamber in full tuck position against the reservoir chamber and held in place by tab exhibiting meaningful communications.

In this example the fold holding means is a tab 13 of a stiff material partially attached by a seal or adhesive 15 to the side of the packet 1 in such a location and manner that the folded distribution chamber 7 with its exit tear 8 can be securely placed and held between the tab 13 and the reservoir chamber 2. Held in this folded manner the packet 1 is resealed, the fold released from this position is unsealed and open. FIG. 6 shows the packet 1 in perspective. FIGS. 7, 8, 9 shows a sequence of side views as the fold is made and held. FIG. 10 shows the packet 1 in fully folded and resealed position. Meaningful communications 16 is shown on the tab 13 by way of example where the holding means bears a message. Further, aside from acting just as a holding means the tab can provide improved control of the liquid movement when transferring due to its greater surface area, attached location, and relatively flat, stiff surface.

EXAMPLE 3

Resealable Packets of Liquid with Case

An embodiment of the polymeric packet 1 shown in FIGS. 11 through 16 has the same structural elements and other attributes as described in Examples 1 and 2. The packet 1 performs in the same manner as described in both examples. The critical closing feature where the packet 1 is folded along a fold line 14 proximate to the controlling barrier 5 and restrictive passage 6 to effect resealing is the same.

In this example the fold holding means is a removable and disassociatable case 17 into which the packet may be inserted and removed. The case 17 may have the generalized form of an envelope slip with a back 20, a closed end 18, and a cutaway 19 on the open end to provide convenient access to the inserted packet 1 for its removal and use. When the opened and folded packet 1 is placed in the case 17 the pressure from the confining walls of the case 17 provides the means to hold the folded packet 1 closed and thus securely resealing it. FIG. 11 shows the packet 1 and the case 17 together. FIG. 12 shows the folded packet 1 with the distribution chamber 7 as it would be for insertion into the case 17, FIGS. 13, 14 show side views of the packet unfolded and folded closed. FIG. 15 shows a side view of an empty case 17. FIG. 16 shows a side view of the packet 1 fully inserted into the case 17, where the fold holding means is supplied by the narrowing walls of the case 17.

More than one packet 1 (not shown) can be carried inside the case 17 with ease, supplying additional amounts of liquid as may be needed. Additionally, the case 17 may be a relatively permanent object of some value, such as tooled leather or engraved metal, and receive multiple replacement packets 1 over time. Typically, however, the case 17 is formed as an advertising wrapper made of paper or plastic and bearing meaningful communications placed there by a distributor such as a restaurant, cruise line, or hospital. The case 17 as a holding means has one additional novel feature; if for any reason there is an unintended discharge or leak from the packet 1, it is contained within the case and prevented from causing any form of subsequent damage.

EXAMPLE 4

Resealable Packets of Liquid with Slide

An embodiment of the polymeric packet 1 shown in FIGS. 17 through 20 has the same structural elements and other attributes as described in Examples 1, 2, and 3. The packet 1 performs in the same manner as described in these examples. The critical closing feature where the packet 1 is folded along a fold line 14 proximate to the controlling barrier 5 and restrictive passage 6 to effect resealing is the same.

In this example the fold holding means is a movable slide 23 encircling the packet 1 that can be moved up or down the packet 1 body or be removed entirely. In FIG. 17 the slide 23 grips only the reservoir chamber 2 and is held in place by the natural tension that seeks to restore the flat elastic plastic slide 23 walls to an original parallel condition. The packet 1 is yet unopened with no tear 8 yet made at the nick 22 which starts the user initiated tear 8. FIG. 18 shows the packet 1 open with a tear 8 and the distribution chamber 7 starting to be folded over. FIG. 19 shows the distribution chamber 7 folded against the reservoir chamber 2 and resealing the packet along the fold line 14, FIG. 20 shows the slide 23 moved up the packet 1 so as to encircle both the chambers 2, 7 in a held folded position effectively resealing the packet 1 and preventing leakage.

It is to be understood that even though numerous characteristics and advantages of the present invention have been set forth in the foregoing description, together with details of the structure, function, and employment of the invention, the disclosures are illustrative only, and changes may be made in details, especially in matters of shape, size, and arrangement of some parts together with content and materials utilized, within the principles of the invention to the full extent indicated by the broad general meaning of the terms are expressed.

Further, throughout this specification various patents are referenced. The disclosures of these references in their entireties are hereby incorporated by reference in order to more fully describe the state of the art to which the invention pertains. What has been illustrated and described herein is an improvement in certain types of squeezable articles of manufacture representative of fluid containers such as packets made of flexible polymeric material in combination with various fold holding means with the specific intent to use these articles to distribute and dispense hand sanitizing fluid to improve hand hygiene in a human population so as to reduce the frequency of pathogenic transmission and subsequently reduce sickness and infectious disease within that population. While these improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical or functional equivalents, and other modifications will become apparent to those skilled in the art upon reading the foregoing description.

What is claimed is:

1. A resealable packet, comprising:

a flexible polymeric packet holding a useful liquid;

a controlling barrier within said packet creating reservoir and dispersement chambers;

a restrictive passage in said barrier permitting fluidic communication of said useful liquid between said chambers;

an exit means for said useful liquid from said dispersement chamber;

a predetermined fold line positioned on said flexible polymeric packet in immediate parallel to said barrier and said passage in a crimping arrangement forming a cooperative relationship capable of preventing said fluid communication of said useful liquid through said passage when said flexible polymeric packet is folded and thus sealed; and a fold holding means capable of maintaining the folded packet in said sealed condition.

2. The packet of claim 1 wherein said fold holding means is a cover.

3. The packet of claim 1 wherein said fold holding means is a tab.

4. The packet of claim 1 wherein said fold holding means is a case.

5. The packet of claim 4 wherein said case stores and seals more than one said folded packets.

6. The packet of claim 4 wherein said case is a relatively permanent object and said flexible polymeric packet is disposable and replaced in said case when depleted.

7. The packet of claim 4 wherein said case contains unintended discharge and/or leakage from said flexible polymeric packet.

8. The packet of claim 1 wherein said fold holding means is a movable slide encircling said flexible polymeric packet.

9. The packet of claim 1 wherein said packet is constructed of at least one flexible polymeric material.

10. The packet of claim 1 wherein said dispersement chamber is used to quantify a dose of said useful liquid before dispersement.

11. The packet of claim 10 wherein said dose quantity may be reduced by transfer back to said reservoir chamber or increased by transfer from said reservoir chamber before dispersement.

12. The packet of claim 1 wherein said flexible polymeric packet and/or said fold holding means is partially and/or fully transparent, translucent, and/or opaque.

13. The packet of claim 1 wherein said flexible polymeric packet and/or said fold holding means bears meaningful communications.

14. The packet of claim 1 wherein said fold holding means is constructed of material that is flexible and/or rigid in part and/or whole and can be used for manipulating liquid transfer within said flexible polymeric packet.

15. A method of resealing a packet according to claim 1, wherein said method comprises folding said flexible polymeric packet at said fold position so as to seal off said fluidic communication of useful liquid through said restrictive passage.

16. A method of claim 15 further including the step of maintaining said folded packet sealed condition by engaging said fold holding means.

17. A method for reducing sickness and infectious disease in a population, said method comprising;

characterizing said useful liquid of claim 1 as a hand sanitizing fluid;

distributing the resealable packet of claim 1 in a population;

dispensing said fluid from said flexible polymeric packet to skin harboring pathogens; and, spreading said fluid on said skin sufficient to effectively reduce the number of said pathogens thereon and so reduce the frequency of pathogenic transmission and so reducing sickness and infectious disease among said population.

18. The method of claim 17 further including the step of providing said flexible polymeric packet and/or said holding means of claim 1 with meaningful communications.

* * * * *